US005339973A

United States Patent [19]

Edwards et al.

[11] Patent Number: 5,339,973

[45] Date of Patent: Aug. 23, 1994

[54] LATCH FOR A CONTAINER

[75] Inventors: Richard T. Edwards, Dublin, Ohio; Edward W. Rider, Jr., Slate Hill, N.Y.; Stephen J. Susta, Jr., Walden, N.Y.; William R. Crawford, Port Jervis, N.Y.

[73] Assignee: Genpak Corp., Middletown, N.Y.

[21] Appl. No.: 883,151

[22] Filed: May 14, 1992

[51] Int. Cl.[5] ..... B65D 43/00

[52] U.S. Cl. ..... 220/4.23; 220/4.21; 220/306; 220/339

[58] Field of Search ..... 220/306, 339, 4.23, 220/4.21, 4.22, 337, 338, 276; 229/2.5 R

[56] References Cited

U.S. PATENT DOCUMENTS

| | | | |
|---|---|---|---|
| 2,798,631 | 7/1957 | Engel | 220/4.21 |
| 2,811,768 | 11/1957 | Axelson | 220/306 X |
| 3,246,786 | 4/1966 | Holley | 220/306 X |
| 3,484,015 | 12/1969 | Rowan | 220/4.21 |
| 3,655,111 | 4/1972 | Surerus | 220/306 X |
| 3,843,016 | 10/1974 | Bornhorst et al. | 220/306 |
| 4,194,645 | 3/1980 | Zabner et al. | 220/306 |
| 4,334,631 | 6/1982 | Ballester | 220/306 |
| 4,397,404 | 8/1983 | Blanchette | 220/306 |
| 4,454,958 | 6/1984 | Juillet et al. | 220/339 |
| 4,602,719 | 7/1986 | Borst | 220/339 X |
| 4,660,735 | 4/1987 | Peschardt et al. | 220/276 |
| 4,753,351 | 6/1988 | Guillin | 220/339 X |
| 4,863,054 | 9/1989 | Capetta | 220/4.23 |
| 4,934,556 | 6/1990 | Kleissendorf | 220/269 |
| 4,962,854 | 10/1990 | Ricci | 220/339 |
| 4,971,220 | 11/1990 | Kaufman et al. | 220/335 |
| 4,976,370 | 12/1990 | Cassel | 220/306 |
| 5,036,997 | 8/1991 | May et al. | 220/335 |
| 5,092,479 | 3/1992 | Wells | 220/4.23 |
| 5,131,551 | 7/1992 | Wells | 220/4.23 |

*Primary Examiner*—Allan N. Shoap
*Assistant Examiner*—Stephen Cronin
*Attorney, Agent, or Firm*—Robert D. Schaffer

[57] ABSTRACT

A container for storing foods or other goods comprising a tray including a bottom and at least one side wall extending upwardly from the bottom, the side wall including a seal flange; a cover including a top and at least one side wall extending downwardly from the top, the side wall of the cover including a second seal flange; wherein each of the seal flanges of the cover and the tray comprise a curved surface, the curved surfaces interlocking over an arc of more than 180° to form a seal between the tray and the cover.

6 Claims, 6 Drawing Sheets

LATCH FOR A CONTAINER

FIELD OF THE INVENTION

This invention relates to containers, and more particularly, to an improved latch for securing the lid or cover of a container to the base of the container.

BACKGROUND OF THE INVENTION

There is a demand in the marketplace for improved methods of sealing perishable consumer products to maintain their freshness. Historically, perishable products such as baked goods and vegetables had to be brought to market and sold quickly before exposure to the atmosphere caused the products to lose their freshness. The advent of plastics resulted in many products being wrapped or packaged in plastic, both in the form of flexible plastic bags and solid plastic containers. The use of plastics has greatly improved the "shelf life" of perishable products, allowing both merchants and their customers to store the products for longer periods of time, resulting in a substantial savings.

A number of sealable containers are currently available and are typically formed from plastic or other lightweight material. For example, U.S. Pat. No. 4,753,351 to Guillin discloses a P.V.C. or polystyrene sealable container that includes a base tray and a hinged cover. The food is placed in the tray and the cover is brought into sealed engagement with the base tray to seal the food from the environment. Similarly, U.S. Pat. No. 4,976,370 to Cassel discloses a container and sealing lid formed of plastic such as polypropylene or polyethylene.

While such containers have successfully increased the life of perishable products, the effectiveness of the container is limited by the ability of the latch between the base of the container and the lid to prevent air from entering the container.

Containers are also used to store goods without isolating or sealing the goods from the environment. For example, certain baked goods are placed in containers for transportation or sale before the goods have cooled. The containers that hold these hot goods are vented to allow air to escape from the container while the goods cool to room temperature to prevent moisture buildup in the container. Such containers, while not sealed from the environment, nevertheless require that a secure latch be used to prevent the lid from inadvertently opening and spilling the goods stored therein.

SUMMARY OF THE INVENTION

The present invention overcomes the disadvantages of the prior art by providing an improved latch which securely attaches the cover of a container to the base of the container. The container of the invention generally comprises: a tray including a bottom and at least one side wall extending upwardly from the bottom, the side wall including a flange; a cover including a top and at least one side wall extending downwardly from the top, the side wall of the cover including a second flange; wherein each of the flanges of the cover and the tray comprise a curved surface, the curved surfaces interlocking over an arc of more than 180° to secure the tray and the cover.

In preferred embodiments the container is plastic and includes a hinge formed of an oriented polymeric material connecting the cover to the base. The tray and cover both include a plurality of side walls. The flanges extend around the entire perimeter of the tray and the cover, and the curved surfaces of the flanges are circular. The radius of the outer surface of one of the curved surfaces is approximately equal to the radius of the inner surface of the other of the curved surfaces.

The improved latch of the invention provides a secure means for latching the cover of a container to the base, decreasing the likelihood that the cover will inadvertently open. When used with a sealable container, the improved latch of the invention forms a tight seal that prevents air from entering the container.

DETAILED DESCRIPTION OF THE PREFERRED EMBODIMENT

Figure 1:
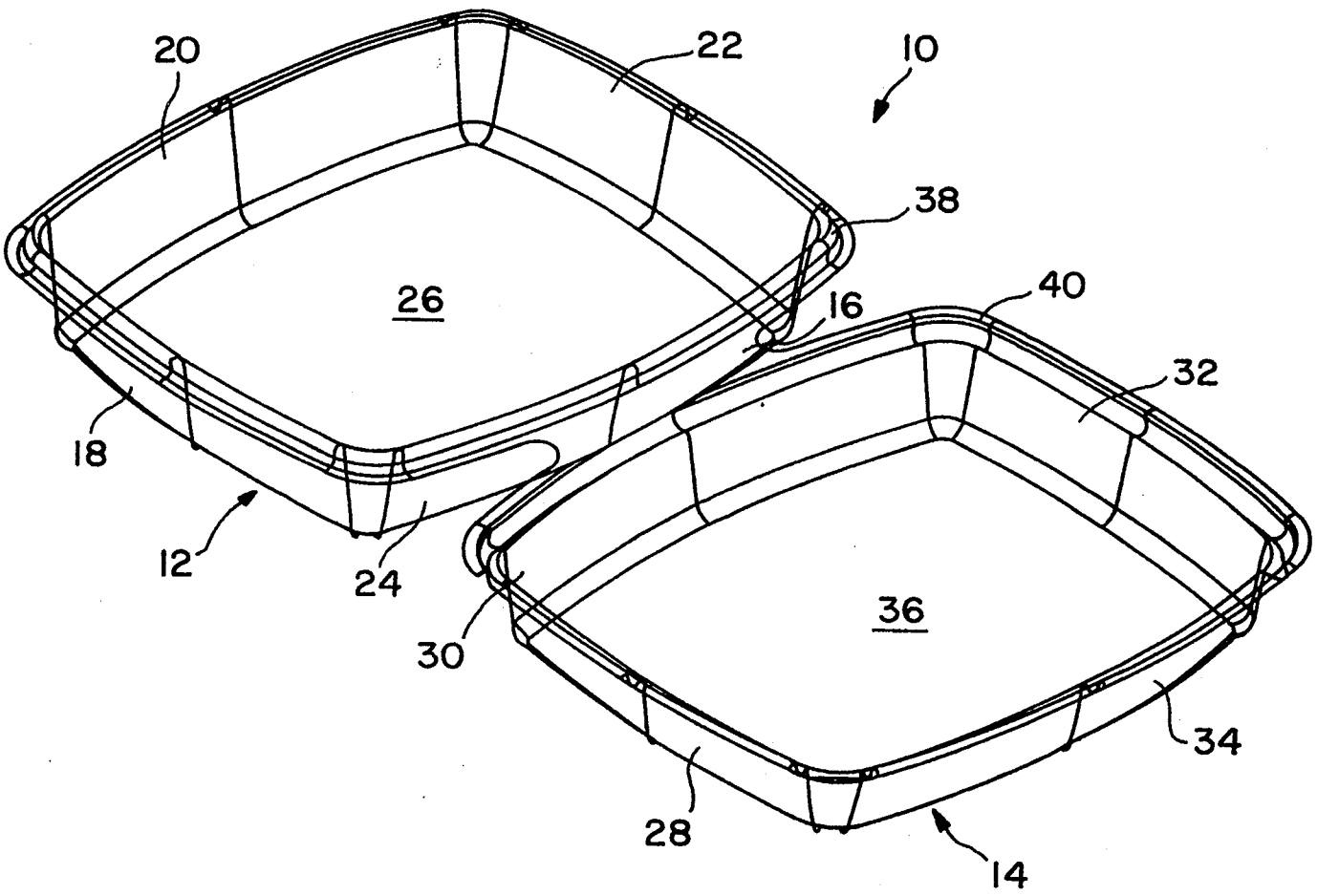
FIG. 1 is a perspective view of one embodiment of a sealable container according to the present invention.

FIG. 1 illustrates a sealable container 10 that includes a tray 12 and a cover 14 connected to tray 12 by a hinge 16. Base 12 has four side walls 18, 20, 22 and 24, extending upwardly from a bottom 26. Similarly, cover 14 includes four side walls 28, 30, 32 and 34, extending from a top 36.

A curvilinear flange 38 surrounds the perimeter of each of side walls 18, 20, 22, 24 of tray 12. A corresponding curvilinear flange 40 is connected to side walls 28, 30, 32 and 34 of cover 14. As is explained in more detail below, when cover 14 is pivoted on hinge 16 to close container 10, flange 38 engages flange 40 and forms a seal that creates a space inside bottom 26 and top 36 that is isolated from the environment outside the container.

Figure 2:
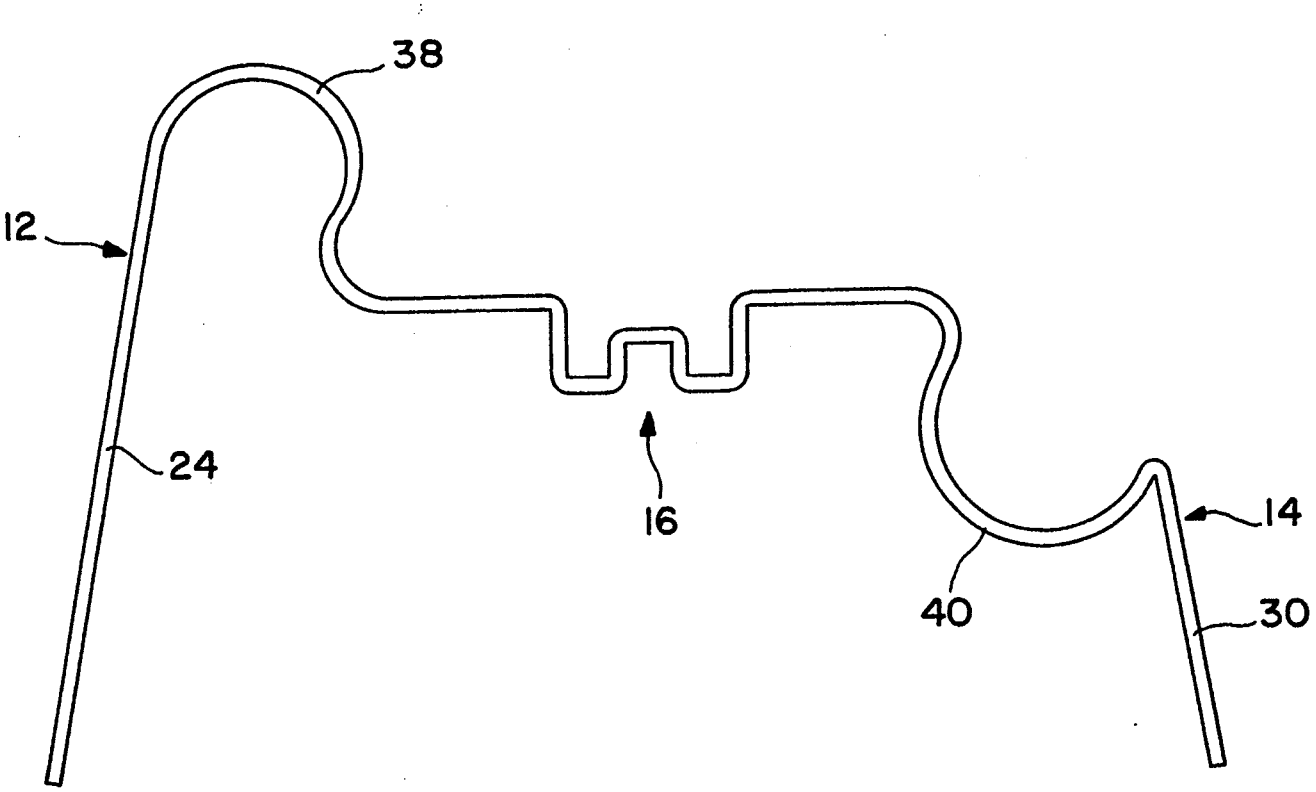
FIG. 2 is a cross-sectional partial view of the container shown in FIG. 1.

FIG. 2 is a cross-sectional view of a portion of container 10 and illustrates a section of wall 24 of tray 12 and a section of wall 30 of cover 14. Wall 24 is connected to wall 30 through flanges 38 and 40 and hinge 16. Each of flanges 38 and 40 has a curved surface that is circular in the preferred embodiment over approximately a 188° arc. FIG. 2 illustrates the container with cover 14 in its fully open position.

Figure 4:
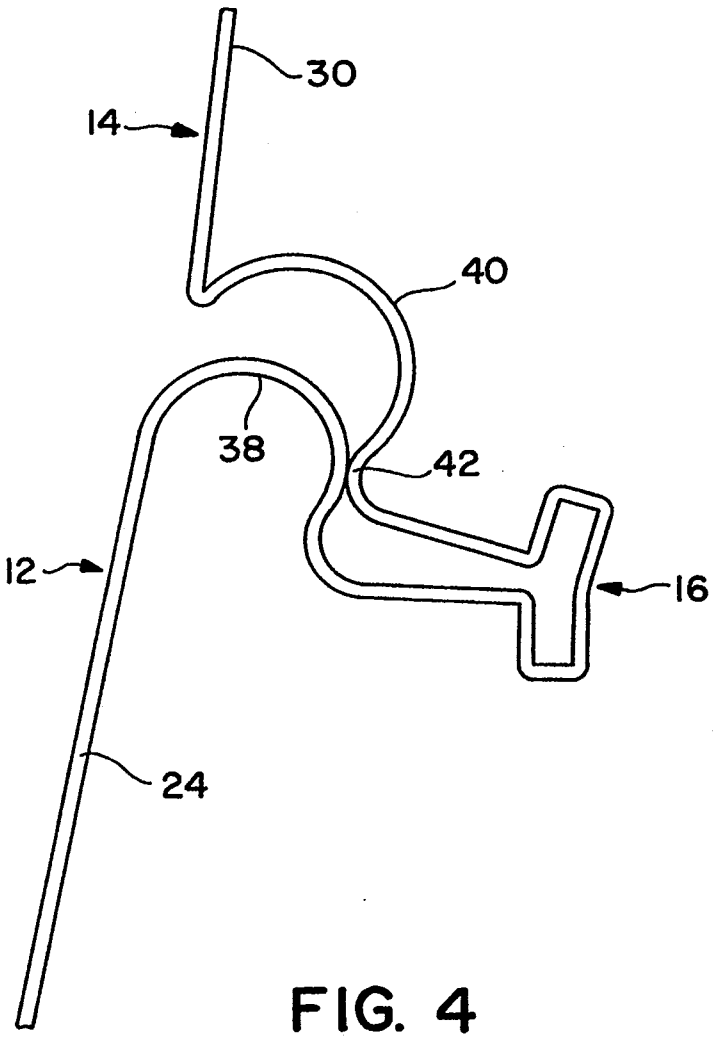
FIGS. 3–5 are a series of cross-sectional partial views of the container shown in FIGS. 1–2 with the container in varying degrees of closure.
Figure 3:
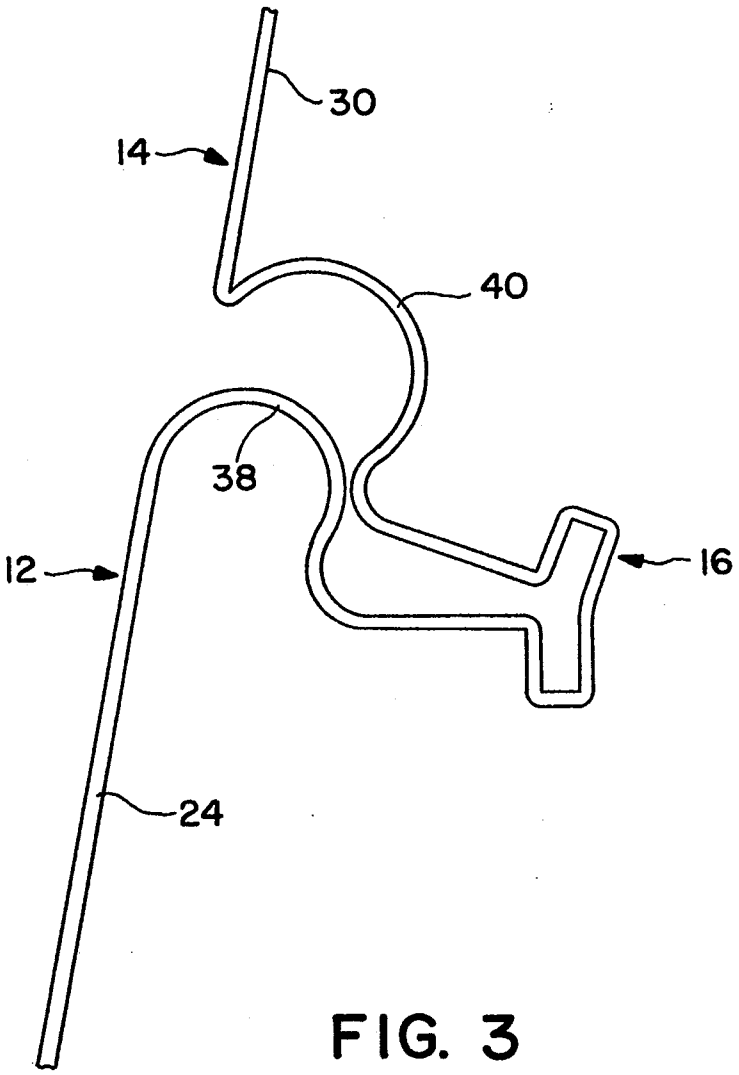

FIG. 3 illustrates a similar cross-sectional view as that shown in FIG. 2, except that cover 14 has been rotated counter-clockwise to a position that is partially closed. As cover 14 pivots on hinge 16 flange 38 of tray 12 will begin to engage flange 40 of cover 14. FIG. 4 shows the point of first contact 42 between flange 40 and flange 38, as cover 14 is rotated counterclockwise slightly more than the position shown in FIG. 3.

Figure 5:
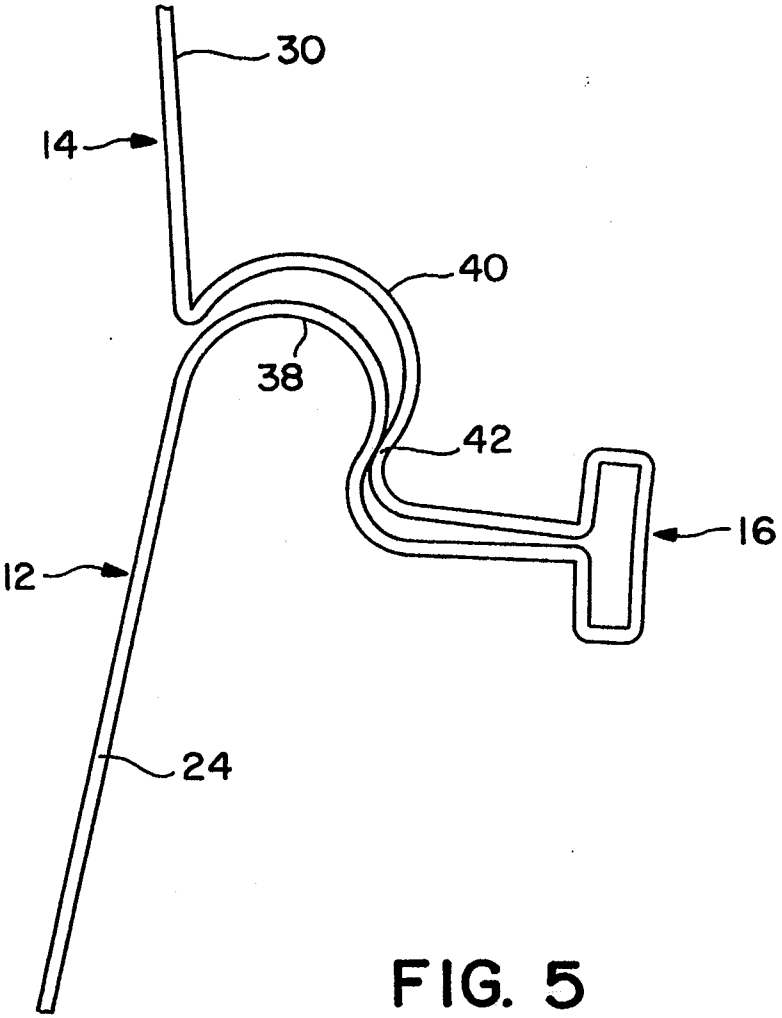

As cover 14 continues to be rotated counterclockwise from the position shown in FIG. 4, the point of contact 42, also known as the point of interference, will cause both flange 38 and flange 40 to deform slightly. Further counterclockwise rotation of cover 14, as shown in FIG. 5, will increase the deformation of flanges 38, 40 and will bring the outside surface of flange 38 closer to the inside surface of flange 40.

Figure 6:
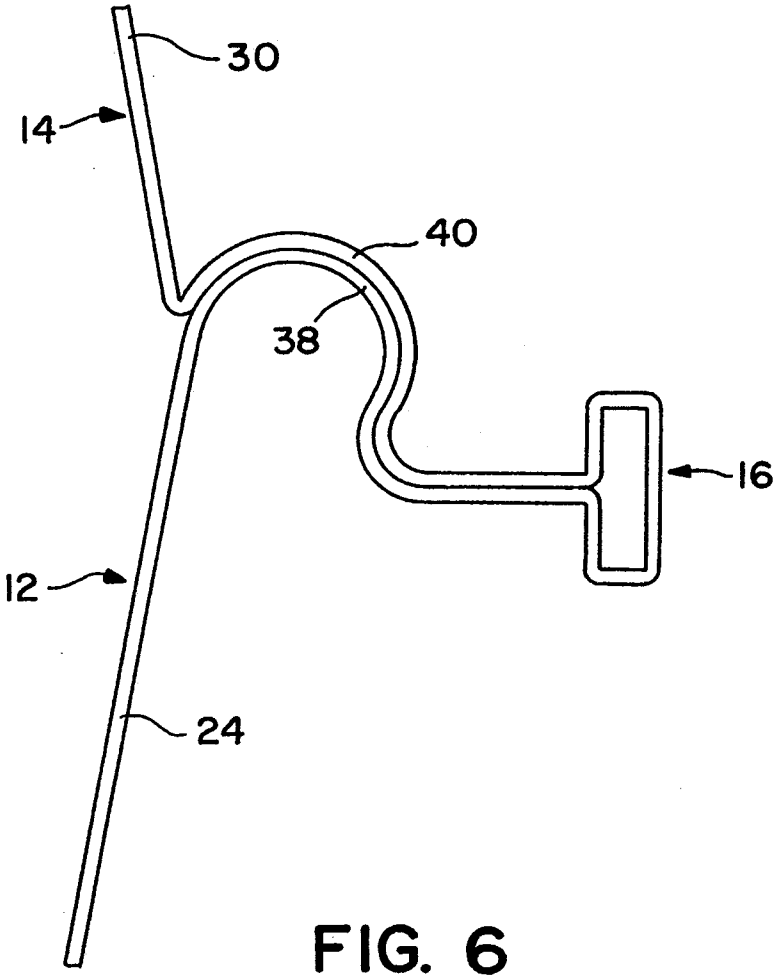
FIG. 6 is a cross-sectional partial view of the container shown in FIGS. 1–5 with the container in a closed and sealed position.

FIG. 6 illustrates cover 14 in a closed and sealed position. Flanges 38 and 40 have approximately resumed their previous shape, i.e., before the deformation caused by contact as shown in FIGS. 4–5. The outer perimeter or outside surface of flange 38 forms a continuous contact with the inside surface of flange 40 resulting in a tight seal between tray 12 and lid 14. The area of contact between outer surface of flange 38 and the inner surface of flange 40 is continuous over an arc of at least 180° and, in the preferred embodiment, over an arc of 188°.

As can be seen in FIG. 6, the outer surface of flange 38 has a radius that is approximately equal to the radius of the inner surface of flange 40, thereby resulting in the tight seal between the two surfaces. Flanges 38, 40 can be constructed so that the radius of the outer surface of flange 38 is slightly more than the radius of the inner surface of flange 40 when the flanges are not engaged. In such a configuration the flanges will deform slightly upon engagement until the radiuses are equal, resulting in a tighter seal.

The tray of the invention is constructed of a suitable material such as polyethylene terephthalate ("PET"), or polystyrene. The tray may be formed using any of a number of standard manufacturing techniques, such as pressure forming from an extruded sheet of material. Pressure forming is a well known process, and includes the steps of heating the extruded sheet to a temperature above the glass transition temperature, and shaping the heated sheet in a male or female mold using a vacuum on one side of the sheet and air pressure on the other side of the sheet. A mechanical force (e.g., plugs) may be used instead of the vacuum and air pressure. Once the sheet is shaped, the polymer is cooled and trimmed using a punch press, saws, routers, or other suitable trimming device.

The container has wall thicknesses in the range from 0.008 inches to 0.016 inches, depending on the size of the container. The material that forms hinge 16 is oriented to have improved strength and a longer working life.

Figure 7:
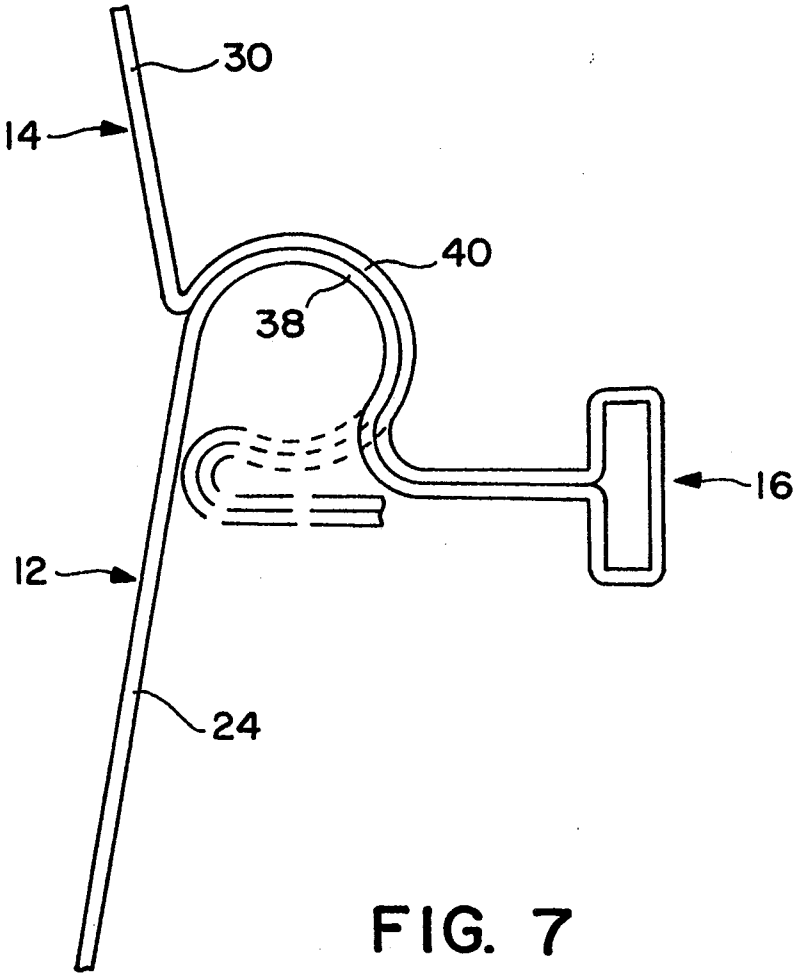
FIG. 7 is a cross-sectional partial view illustrating alternate embodiments of a curved surface of a seal flange illustrated in FIGS. 1–6.

FIG. 7 illustrates the preferred range for the area of contact between the outer surface of flange 38 and the inner surface of flange 40. As noted above, in order to achieve the interference fit between the two flanges, this area of contact must cover at least a 180° arc and preferably 188°, as shown in the solid line in FIG. 7. The upper limit of the contact arc is about 240°, as illustrated with the dashed lines in FIG. 7.

Figure 8:
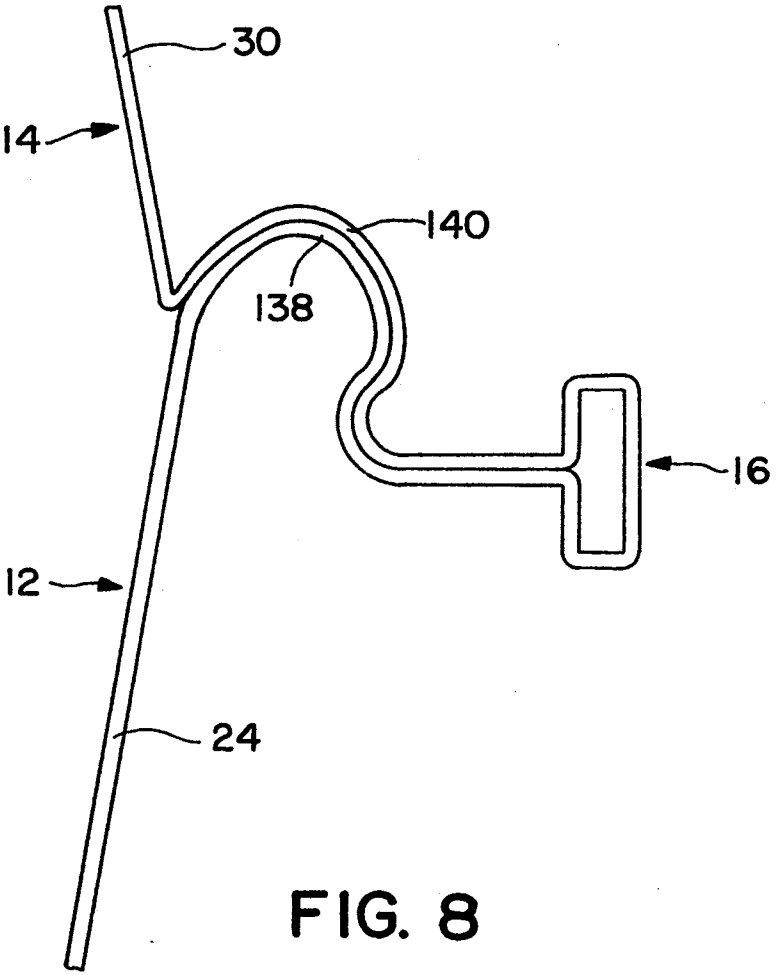
FIGS. 8–9 are cross-sectional partial views of two alternate embodiments of sealable containers according to the present invention.
Figure 9:
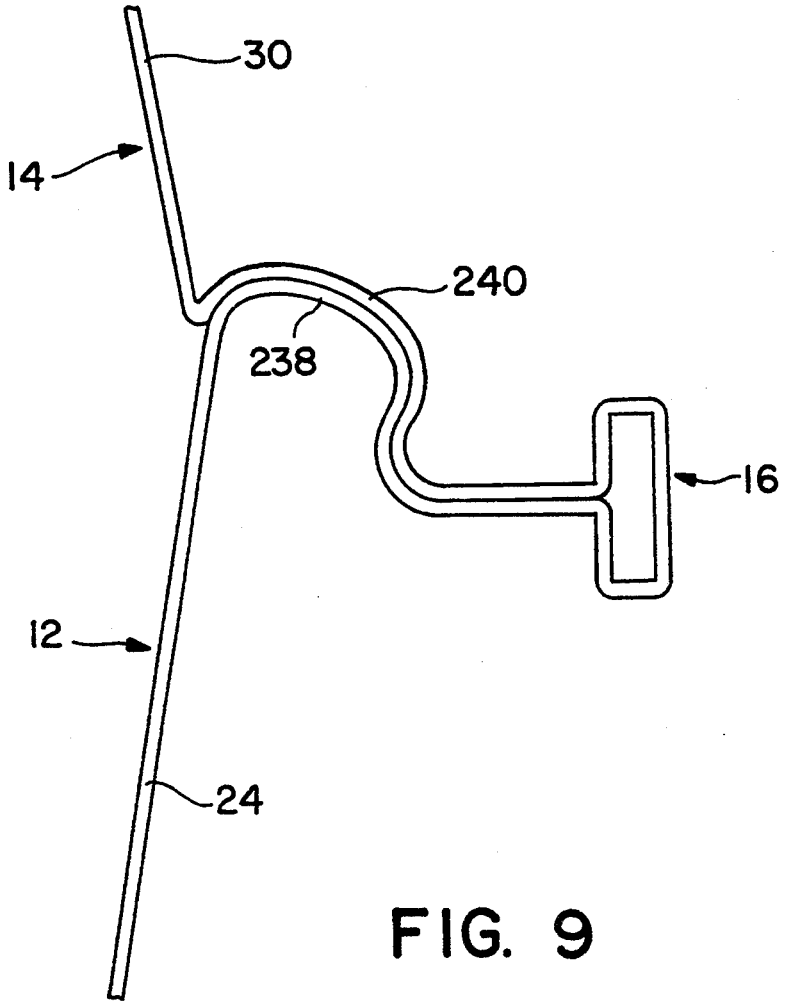

FIG. 8 illustrates an alternative embodiment of the flanges used to seal the container of the invention. Flanges 138 and 140 have an asymmetric shape as compared to the circular shape of the flanges illustrated in FIGS. 1–7. FIG. 9 illustrates yet another variation in the shape of the flanges and shows flanges 238 and 240 that have a conical shape.

The embodiments described above are merely illustrative of the invention and other embodiments may be constructed within the scope of the appended claims. For example, although the invention has been illustrated in a sealable container, the improved latch of the invention can be used to secure the lid of vented containers. The tray illustrated in FIG. 1 could be modified to provide vents by eliminating a portion of flange 31. Such a container would allow air to circulate between the inside of the container and the outside environment, yet would still exhibit the advantages of the secure attachment of the cover to the base that is achieved by the invention.

Similarly, while PET has been described as one preferred material for forming the tray of the invention, other suitable materials will be apparent to those of ordinary skill in the art.

We claim:

1. A container comprising:

a) a tray including a bottom and side walls upwardly extending from said bottom, said upwardly extending side walls include a first rim extending radially outwardly from said upwardly extending side walls, in the form of an upwardly extending protrusion and wherein said first rim is continuous around the periphery of said tray; and b) a cover hingedly connected to said tray wherein said tray, said cover, and said hinged connection are molded as a single unitary structure, wherein said cover is adapted for moving from an open position to a closed position, and wherein said container is nestable with an identical container when said cover is in said open position, said cover including a top and side walls downwardly extending from said top, said downwardly extending side walls include a second rim extending radially outwardly from said downwardly extending side walls in the form of a downwardly opened substantially arcuate channel, and wherein said second rim is continuous around the periphery of said cover, said hinged connection comprising a hinge joined to said cover and said tray radially outwardly of said first and second rim, wherein said first rim has a first radius and said second rim has a second radius, and wherein said first rim is interlockable with said second rim over a substantially curved arc having continuous contact over more than 180°, thereby securing said tray with said cover around the entire periphery of the container.

2. The container of claim 1, wherein said hinge is formed from an oriented polymer.

3. The container of claim 2, wherein the container is plastic.

4. The container of claim 1, wherein said arc is circular.

5. The container of claim 1, wherein said first rim mates with said second rim along their entire surfaces.

6. The container of claim 1, wherein said tray is secured in air tight engagement with said cover.

* * * * *